United States Patent [19]

Mitchell et al.

[11] 4,372,480

[45] Feb. 8, 1983

[54] TILT-OUT BOX FOR MAIL AND THE LIKE

[76] Inventors: Terry L. Mitchell, 6880 Belhurst, Jenison, Mich. 49428; Robert L. Russell, 1193 48th, SE., Kentwood, Mich. 49508

[21] Appl. No.: 259,677

[22] Filed: May 1, 1981

[51] Int. Cl.[3] ..... B65D 91/00

[52] U.S. Cl. ..... 232/28; 232/17; 220/334; 312/325

[58] Field of Search ..... 232/17, 19, 28, 29, 232/27, 23, 20, 43.4, 43.5, 65; 220/20.5, 333, 334; 16/336–369; 312/325; 49/246, 227

[56] References Cited

U.S. PATENT DOCUMENTS

| | | | |
|---|---|---|---|
| 392,028 | 10/1888 | Hagerty | 232/28 |
| 725,101 | 4/1903 | Lieber | 232/17 |
| 926,613 | 6/1909 | Barlow et al. | 232/28 |
| 1,062,261 | 5/1913 | Smith | 312/325 |
| 1,469,730 | 10/1923 | Nichols | 232/17 |

FOREIGN PATENT DOCUMENTS

| | | | |
|---|---|---|---|
| 188825 | 4/1937 | Switzerland | 49/246 |

*Primary Examiner*—Gene Mancene
*Assistant Examiner*—John Weiss
*Attorney, Agent, or Firm*—Miller, Morriss & Pappas

[57] ABSTRACT

A mail or storage box for suspension between spaced-apart parallel vertical members and secured thereto in cover contact with a horizontal plane surface. The box is suspended by means of a compound pivoting arm arrangement to close against the cover surface and to be capable of opening from the front or rear in such a manner that upon opening the edge of the box falls away from the cover while progressively tilting as the opening proceeds toward a stop position where the contents are revealed and presented to the person opening the box. On closing a reverse progression occurs. Compound pivoting is achieved using a pair of pivot arms at both ends of the box and arm both pivotally secured to the end closure of the box at the top and at the bottom to an attachment plate. The attachment plate is the means for suspending the box in the space between the vertical supports and against the upper closure. The box may be used in spaced vertical sequence so that plural of the boxes are mounted between the same vertical supports. Front and rear locks are provided and users of the box in rural delivery situations need not get into the street to empty the contents of the box. Weather seals are provided between cover and box at front and back. The boxes are drained and signals are selectively attached thereto.

8 Claims, 7 Drawing Figures

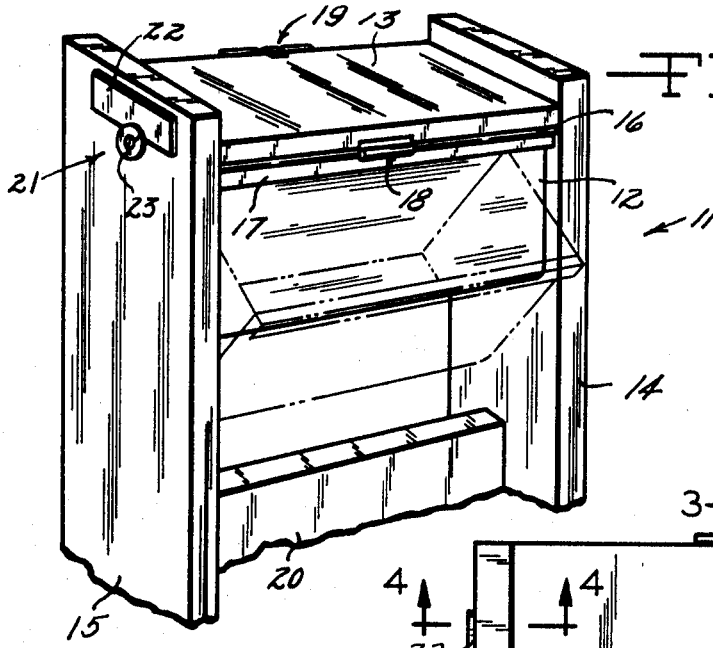
FIG. 1
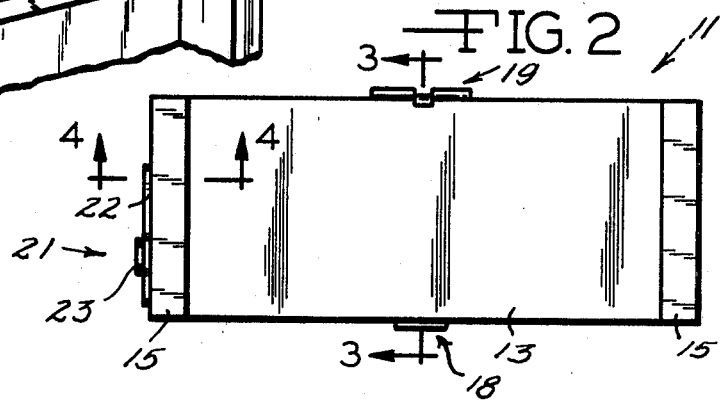
FIG. 2
FIG. 3
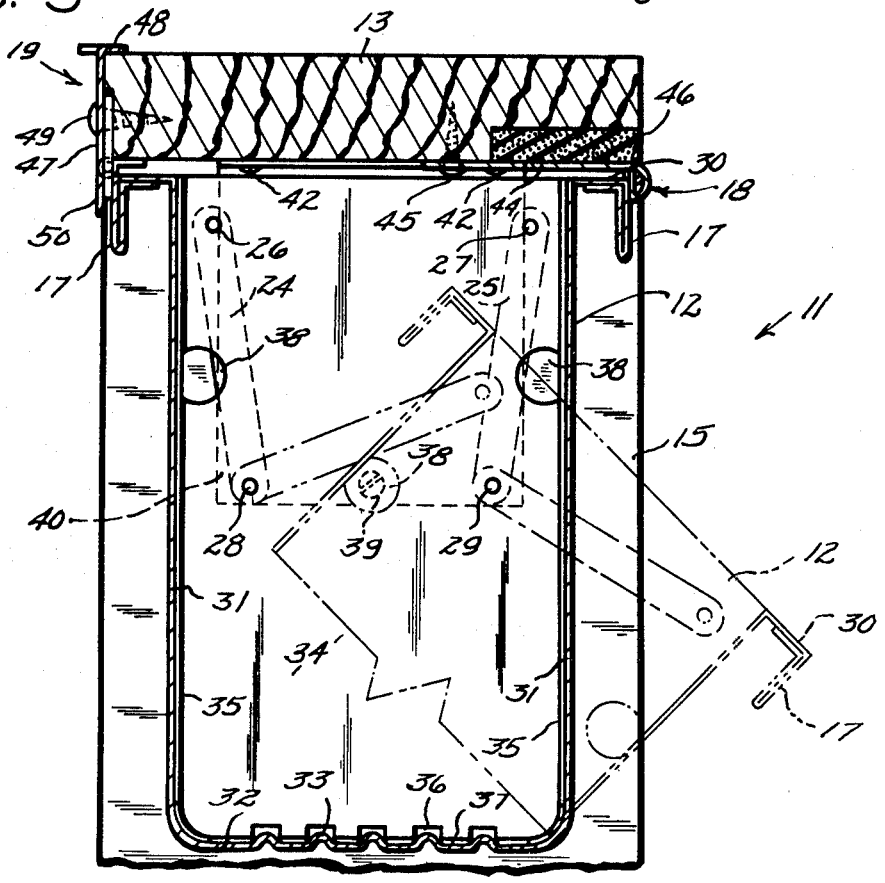

TILT-OUT BOX FOR MAIL AND THE LIKE

The present invention is a tilt-out storage box as for mail and the like or the storage of items where the ability to vertically stack plural storage units is desired while allowing selective access to the box from the front and rear. In the storage position, the box is closed and in the open position the box falls away from the cover and tilts controllably outward from its closed rest position to a fully opened and selectively tilted stop position. The box is attached in assembly to the tilt-out mechanism and requires only attachment between two spaced-apart vertical supports. A horizontal spacer between the verticals serves as a cover element.

In the prior art, tilt-out letter box devices are not unknown but for the most part they have been constructed on a simple pivot, are not locatable between vertical spaced-apart supports and to not function to close against a planar horizontal element. For the most part, post boxes have been supported on single posts and little or not attention has been given to a box which can be opened from both sides and where the pivotal structure causes the box to fall away from its cover and to limitedly tilt open. Very little attention has also been given in the past to a box which is useful in tiered relationship for rural delivery as, for example, in plural unit dwellings.

The best known examples of prior art are exemplified in the U.S. Pat. No. 392,028 to J. S. Hagerty, a device which pivots to open, left and right, from under a curvilinear shroud and which is attachable to a post or plate. The mail box of Nial R. Sheets and William E. Barlow in the U.S. Pat. No. 926,613 provides a swing basket type structure pivotally supportable between clevis-like arms. The cover tilts with the structure. While useable in clusters, these devices are each on what amounts to a single post with each clevis element at the top thereof. Such devices are unrelated to the significant advance in the art exemplified in the present mail or storage box structure.

Accordingly, the principal and unobvious objective of the present invention is to provide a compound pivoting mail or storage box useable for mounting between a pair of vertical supports or panels and which closes and opens against a planar or shelf-like cover and which, upon tilting to open, displays the contents to the opener of the box from the front or rear. The opening of the box occurs by rotation of the box on the longtiudinal axis therethrough as the axis itself is in motion.

Another object is to provide a mail or storage box structure which can be tiered or stacked so that plural boxes may be supportable between the spaced-apart vertical support elements while maintaining the compound tilting from front and rear.

Still another object is to provide a structure which blends aesthetically with modern building construction and which is more durable and easier to install than prior mail and storage boxes.

Other objects, including drain features, economy, convenience, improved latching, and simple signalling means will be apparent to those skilled in the art as the description proceeds.

IN THE DRAWINGS

FIG. 1 is a perspective view of the present invention and indicating the tilt-out position of the box in phantom line.

FIG. 2 is a top plan view of the structure seen in FIG. 1.

FIG. 3 is a cross section elevation view of the structure shown in FIG. 2 and taken on the line 3—3 thereof and showing the tilt-out position of the mail or storage box in phantom line.

GENERAL DESCRIPTION

Figure 4:
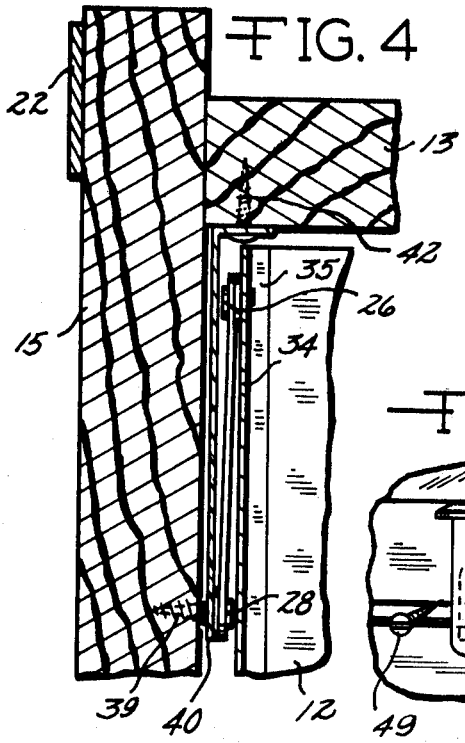
FIG. 4 is a partial section elevation view taken on the line 4—4 of the FIG. 2 and indicating the compactness of the swing arms between the mounting plate and the box and indicating the simplicity of the attachment of the plate to the horizontal cover member.

In general, the post box or mail box of the present invention is horizontally oriented and is suspended at both ends on articulated pivot arms. The pivot arms retain the receptacle or box portion in an upright elevated position against a horizontal member or cover and the horizontal cover is supported between a pair of vertical posts. The pivot arms at each end have their lower pivot points in a fixed relation to the vertical posts at the lower ends of the arms. The upper ends of the arms are pivotally attached to the end plates of the box in such a manner that outward movement of the box from beneath the horizontal cover causes a compound motion outwardly and downwardly and accompanied by a rocking motion through a limited travel. The travel is limited by interference engagement of the arms. The opening motion frees the box from closure against the top and tilts the box to reveal the contents thereof to the person opening the box. Reversal of that motion returns the box to its closed position against the horizontal cover element. Suspension of the box is best achieved by the interposition of a mounting plate or attachment plate which includes the lower pivots, means for attachment to the horizontal cover and which includes provisions for fixing the structure to the adjacent vertical support elements. This construction simplifies fabrication and minimizes difficulty in mounting the box structure to its supports. The box has a generally U-shaped cross section, open at the top and including a horizontal upper flange and a downturned integral lip which serves as an opening and closing handle on both sides of the box. The end plates are secured to the ends of the box and are co-terminal in height with the upper flange of the box. The end plates carry the upper pivotal connections of the box to the arms. The end plates have at least one opening therethrough which, upon opening of the box, aligns itself with a fastener which secures the mounting plate to the adjacent vertical support.

Latch means are provided at the front of the box and the rear of the box and the latches secure the box against chance opening and are selectively disengaged for opening the box. Drain provisions are made in the bottom of the box and longitudinal corrugations in the bottom of the box elevate the contents of the box from any residual dampness or water which might collect in the box. The upper flange of the box at front and back closes against the horizontal cover and gasketing material positioned therebetween renders that closure substantially weather-tight and cushions the closure of box against cover.

Where the box is used as a mail box, a simple signal is secured, as required, to one or the other sides of the vertical supports. Plural boxes may be used intermediate the same posts by including plural spaced-apart horizontal cover elements in successive vertical stages or tiers. Each box is located against the respective cover on the underside thereof and between the vertical supports. Variants are decoratively encouraging using staggered tiers for plural box installations. Without the signal, the box as described herein, is useful as a parts bin or accessory storage accessible from front and rear and including the swing-out and tilt features, the latter revealing the contents very quickly and economically. The unit is easily prefabricated so that no more than six fasteners secure the unit in operative connection to the cover and between the vertical support elements.

SPECIFIC DESCRIPTION

Referring to the drawing and with first reference to the FIG. 1 thereof, the mail or post box unit 11 is illustrated in closed position and in open position in phantom line. The box 12 is an elongate open topped structure suspended from the horizontal cover element 13 and between the two spaced-apart vertical elements 14 and 15. As will be seen, the box 12 can tilt out frontwardly, as seen in phantom line, or rearwardly in a substantially similar fashion so as to drop away from closure against the cover 13 at the seal or gasket 16 and the rolled lips 17 of the box 12 along front and back facing upper edges of the box 12 act as handles facilitating the initial opening. A front latch element 18 is springable over the lips 17 and is selectively unlatched as will be seen. A rear latch element 19 is selectively closed and opened to secure the box 12 in the closed position against the cover 13 or to permit outward and downward inversional tilting of the box 12. Thus, the box 12 is capable of opening from both sides. In storage situations and in rural delivery situations, if the front of the box 12 faces the road, then the householder or box user can load and unload the box 12 from the backside away from traffic. The spacer element 20 extending across the gap between the vertical supports 14 and 15 assures appropriate spacing between the vertical support elements 14 and 15 and stabilizes the simple and effective support structure. The verticals 14 and 15 are preferably cast into a cement footing (not shown) so that the receptacle or box 12 is located at a convenient elevation for rural delivery access and at a convenient access height for the user of the box 12. Other mounting means, such as using channels case in cement and to which the verticals 14 and 15 are secured, are also contemplated.

Preferably, for example, the verticals 14 and 15, the horizontals 13, and the spacers 20 are made from treated 2"×8" limber. Treated lumber resists ground rot and termite infestation and thus preserves the support structure squared, as shown, and firmly attached together as by wood screws, nails or the like. While wood is the preferred material, metal channels or composites in structural and ornamental iron, steel, and aluminum may be used for support.

For postal purposes, the boxes 12 may have a signal flag 21 related thereto which is selectively used as an indicia by the postman or user for signifying the presence of mail. The simple form of the described signal flag 21 is a pivotal arm 22 which has one stop position in the horizontal position against the stop brake 23. This is selectively positionable on either side of the support structure on the outside of elements 14 and 15, for example, as required.

FIG. 2 indicates that the horizontal element 13 conceals and covers the otherwise open topped box 12 between the verticals 14 and 15 and indicates the latches 18 (front as seen in FIG. 1) and 19 (rear as seen in FIG. 1). The signal or flag 21 is shown on the vertical element 15 for mail signalling usage.

In FIG. 3, taken through the latches 18 and 19, the inventive box unit 11 is best understood since its function is expressed in the phantom line positioning of the compound pivoting and tilting movement of the box or receptacle 12 on the pivot arms 24 and 25. These arms 24 and 25 are similarly arranged on the other end of the box 12. At the top of the arms 24 and 25 are pivotally attached to the box 12 at the top ends thereof as by rivets 26 and 27, respectively, acting as movable journals or pivot pins. As the box 12 tilts and drops away from the cover 13, upon opening, the arms 24 and 25 remain in relatively fixed position on their lower pivot pins 28 and 29, respectively. The location of the pivot pins 28 and 29, as will be seen, are established in respect to the immovable vertical elements 14 and 15. The fixed pivots 28 and 29 are also symmetrically inset from the upper movable pivots 26 and 27, respectively, considered at the time that the pivots 26 and 27 are at their uppermost points of travel. In this rest position, the upper movable pivots 26 and 27 are in horizontal alignment through their centers and the lower fixed pivots 28 and 29 are in lower horizontal alignment parallel to the upper horizontal alignment. The lower fixed pivots 28 and 29 are slightly inset from their upper counterparts. This achieves the described motion of the box 12 in a compound movement which drops, projects and tilts the box 12 from its rest position in full line to its tilt-out position in phantom line. Gravity acting on pivot arms 24 and 25 facilitates ease of opening and provides content exposure from both sides of the unit 11. The box 12 is relatively deep and is formed from a sheet of material doubled upon itself to form the lips 17 on both sides which provide an integral handle downturned from the flanged upper edge surface 30 which engages, as will be seen, the horizontal cover element 13 via a suitable weather-proof gasketing along the face. The sides 31 of the box 12 are integral and extend upward from the bottom 32 which is preferred as an integral extension of the sides 31. The bottom 32 includes a drainage facilitating means such as the longitudinal ridges or corrugations 33. End plates 34 close each end of the box 12 as by the flanges 35, seam welded, spot welded, or otherwise affixed to the end edges of the sides 31 of the box 12. Drainage vents 36 are provided by openings adjacent the ends of the corrugations 33, as shown. The bottom flange 37 extends between the corrugations 33 for enhancing attachment to the box 12 at the bottom as by welding or the like. Where, for example, economy allows the molding of the box 12 as by drape molding, injection molding, or the like, the end plates 34 may be made integral with the sides 31 and bottom 32 without departure from the spirit of the present invention. One or more openings 38 in the end plates 34 provide assembly access to the single fastener 39 at each end of the box 12 which secures a mounting plate 40 to each vertical element 14 and 15. The mounting plate 40 includes a pierced upper flange 41. Fasteners, such as screws 42, attach the flange 41 to the cover 13. Together with the fasteners 39, these flange fasteners 42 carry the load of the box 12 as transmitted through the pivots 28 and 29 into the box support elements 14 and 15 and cover 13. Thus, the three fasteners 42 and 39 at each end of the unit 11 are the only fasteners required to suspend the box 12 in operative relation between the uprights 14 and 15 and from the horizontal cover 13.

The latches 18 and 19 are best expressed in the FIG. 3 and their functional simplicity can be easily appreciated. The latch 19 is a single strip or latch plate 44 of resilient material such as metal having a downwardly curled forward edge 43 as shown in an overlapping interference fit over the edge of the lips 17 of the box 12. The latch plate 44 is fastened to the underside of the cover 13 by a fastener 45 inboard of an inset resilient block 46 such as foamed rubber polyurethane or the like so as to provide a fulcrum at the edge of the block 46 and spring means for the latch plate 44 and allowing the plate 44 to be raised into the block 46 to release the lips 17 and allow the box 12 to be opened by its arm-determined compound dropping and tilting movement. Upon release of the latch 18 from its open position, the resilient block 46 returns the latch plate 44 to its normal latch position, as seen. On closing the box 12, as the flange 30 on the upper edge of the box 12 rises on the arms 24 and 25, the closing compound action lifts the latch 18 until the lips 17 clear the overhanging seal 16 and the latch 18 then springs into its normal holding mode as shown.

The latch 19 is a plate 47 pivotally secured by fastener 49 to the cover 13 and including a stop extension 48. In the closed position, as shown, the latch plate 47 includes an extension 50 which interfers with movement of the box 12 rearwardly on the compound pivoting structure. However, as will be seen, the latch 19 is selectively operable by rotation on the fastener 40 moving the extension 50 out of blocking relation. Then, by light outward application of force on the handle 17, the box 12 tilts out rearwardly as formerly described frontally.

In FIG. 4 the mounting plate or attachment plate 40 is best appreciated adjacent the ends of the box 12 secured to the upright 15 by means of the fastener 39 and to the cover 13 by the fasteners 42. A similar but opposite facing flanged mounting plate 40 is provided at the other end of the box 12 and is attached to the upright element 14 and to the cover 13. The connection of the pivot arms 24 and 25 to the box 12 is alike on both ends of the box 12.

Figure 5:
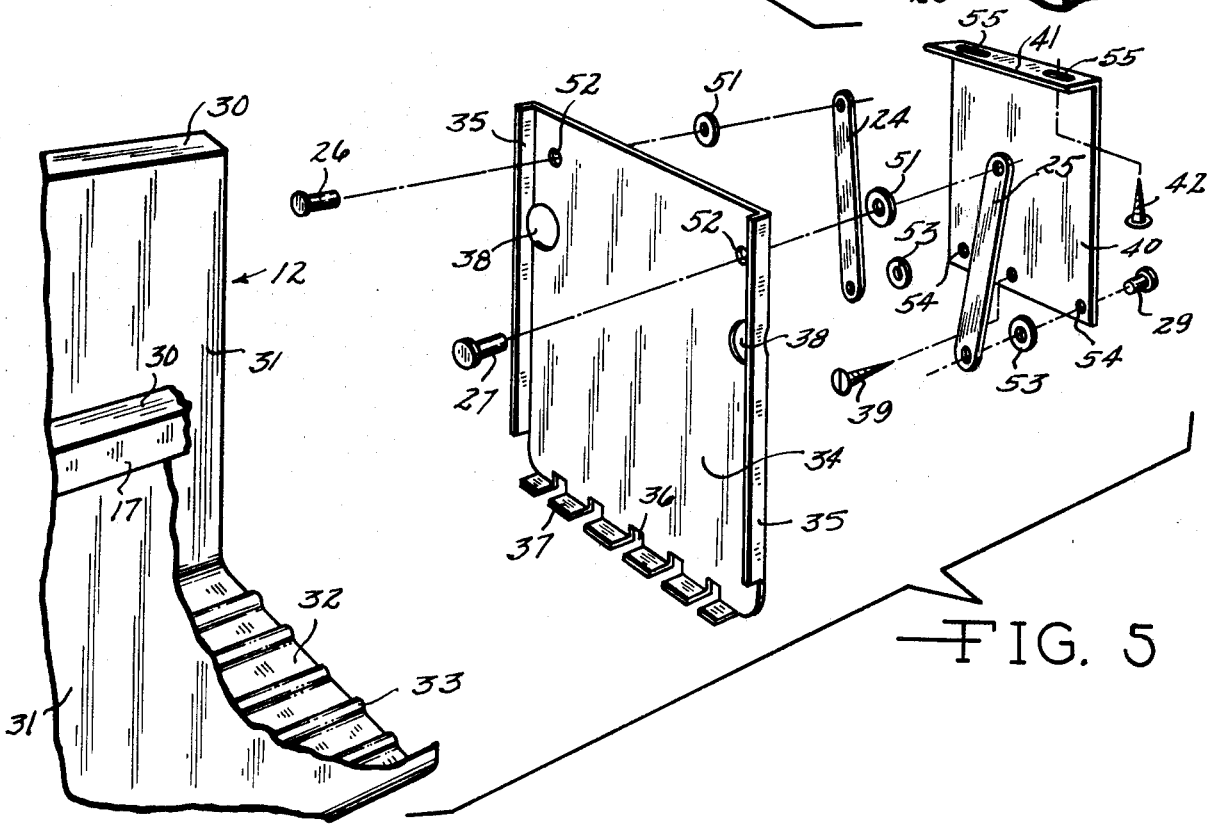
FIG. 5 is an exploded perspective view of one end of the box, its end cover, the swing arms, and the mounting plate with indicated fasteners and showing the simplicity of assembly of the mail or storage box unit.

The exploded perspective view of FIG. 5 best explains the prefabrication and assembly of box 12 with flanged end plates 34 and the connection of box 12 to mounting plate 40. The pins 26 and 27 provide pivotal connection of the arms 24 and 25 to the upper part of the end plate 34 of the box 12 and the thrust washers 51 provide a spacing and journalling function on the pivot pins 26 and 27 through the openings 52 in the end plate 34, as shown. The pins 26 and 27 are preferred as the shown headed rivets.

The lower fixed pivotal connection of the arms 24 and 25 to the mounting plate 40 is also by the rivet pins 26 and 29, respectively. As best appreciated in FIG. 3, the arms 24 and 25 are symmetrical on either side of an imaginary plane passed vertically through the longitudinal centerline of the box 12 and the lower fixed pivots 28 and 28 are towed in slightly from the upper pivots 26 and 27 at rest with box 12 in closed position to achieve the desired controlled movement during opening. The fastener 39, accessible via the openings 38 through the end plates 34, allows the connection of the mounting plate 40 to the end verticals 14 and 15. The slotted openings 55 accommodate the fasteners such as screws 42 to fasten the flange 41 to the cover 13. The assembly of box 12, end plates 34, arms 24 and 25, and mounting plate 40 is achieved prior to attachment to the verticals 14 and 15 and the horizontal spacing cover 13. At final field assembly, the screw 39 and fasteners 42 at both ends complete the mounting of box 12 to the assemblage of FIG. 1.

Figure 6:
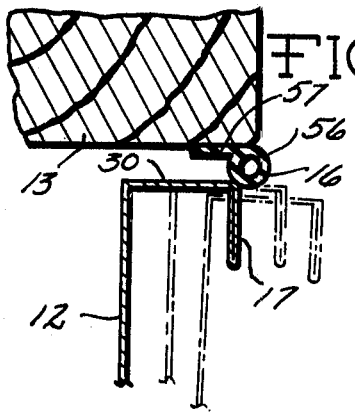
FIG. 6 is a partial cross section view through the cover and upper edge of the box and indicating the seal relationship on closure of the box and indicating the sequential or progressive dropping and pivoting of the box on the compound pivot elements.

FIG. 6 illustrates the closure of the longitudinal flange 30 of box 12 against the longitudinal gasket or seal 16 so that the rolled lip or handle 17 rests in weather-tight connection at closure. The gasket 16 is thus between the box 12 and cover 13 and secured to the cover 13. The seal 16 has a compressible portion 56 and the integral skirt 57. The skirt facilitates adhesive or other fastening along the edges of the cover 13. The phantom lines showing of the box 12 indicates the opening and closing of the box 12 as the flange 30 falls away from the full line rest position and then returns upwardly through a compression of the seal 16 at closure.

Figure 7:
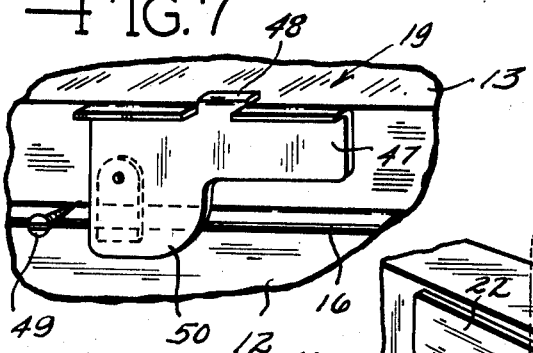
FIG. 7 is an enlarged perspective fragmental view showing the rear stop and lock between the cover element and the box lip. In phantom line, the unlocked position is shown.

FIG. 7 best illustrates the rear latch 19 pivotal on the fastener 49 against stop 48 resting on the top cover 13 with the lobe extension 50 in prevention of the outward movement of box 12. Rotation of the plate 47, as shown in a counterclockwise manner, lifts the stop 48 through 90 degrees to rest again on the cover 13 but with the lobe or extension 50 free of interference with movement of the box 12. Other latches, including the latch 18, may be used.

Figure 8:
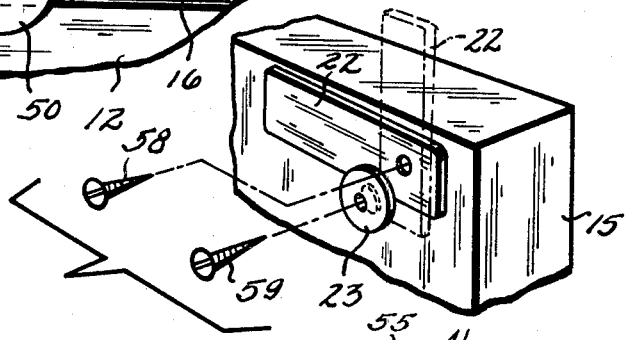
FIG. 8 is a partial perspective view that illustrates the simple signal flag which is selectively attached to either wall of the vertical support elements when the structure is used as a mail box. In phantom line, the signal flag is shown erected and against the position stop of the friction brake.

FIG. 8 shows a detail of the visual signal of flag 21. The simplicity is readily appreciated, the arm 22 pivotal on the pin provided by the fastener 58 and the arm 22 limited in its throw by the stop brake 23 and in rest against the securing brake fastener 59. The signal 21 is shown as when no mail is in the box 12. Rotation of the arm 22 (clockwise, as shown) elevates the arm 22 to the vertical as is desired when mail is placed in the box. The signal 21 may be positioned on either the vertical element 14 or 15. The signal flag 21 is easily shipped with separate fasteners 58 and 59 for field assembly.

In operation, the box 12 is sheltered, as secure in a sturdy frame work, is sealed against weather, is drained, is roomy and economical and the functional parts are long wearing and the movement highly advantageous.

Having thus described our invention, its preferred structure, its tiered or stacked aesthetic capability, its strength, simplicity, and weathering merits, those skilled in the art will perceive improvements, changes and modifications within the skill of the art. Such improvements, changes and modifications are intended to be included herein limited only by the spirit of our hereinafter appended claims.

We claim:

1. A tilt-out box for mail and the like locatable between two spaced-apart vertical supports and beneath a horizontal cover comprising:

an elongate open topped box between said vertical supports;

a pair of spaced-apart pivot arms at each end of said box and pivotally secured at one of the ends of said arms to said box and at the other ends of said arms pivotally and fixedly connected to said vertical supports and said box in the uppermost position on said pivot arms being in closed contact with said horizontal cover; and normally closed latches on each side of said box retaining said box in closed contact with said cover until said latches are selectively disengaged.

2. A tilt-out box for mail and the like comprising:

a pair of spaced-apart parallel adjacent vertical support posts;

one or more horizontal cover elements in spaced relation between said vertical posts and supported thereby;

an elongate box beneath each horizontal cover and between said vertical posts;

pivotal means adjacent the ends of each box and pivotally connected to the ends of said boxes, and said pivotal means each having a fixed pivotal connection to said vertical supports whereby at closed position said boxes close against respective of said cover elements and upon opening drop said moves box downward and outward in the direction of opening while titling to reveal the contents of said box.

3. A tilt-out box for mail and the like comprising the combination of claim 2 wherein said fixed pivotal connection at each end of said boxes are secured to an adjacent mounting plate and said mounting plate is fixedly secured to said adjacent vertical post and to said horizontal cover element.

4. A tilt-out box structure for mail and the like for suspension between a pair of spaced-apart vertical supports and beneath a horizontal cover plate spanning the gap between said vertical supports comprising:

an elongate box having end plates closing each end of said box, said box being open at the top and including a front and rear downturned flange for the entire length of the box;

a pair of pivot arms at each end of said box and having pivot connecting means at each end, the upper ends of said pivot arms being pivotally connected to said box ends in spaced-apart relation and movable with movement of said box;

a mounting plate adjacent each end of said box having an upper connecting flange and pivotally attached to the lower ends of said pivot arms, said mounting plate having means for attaching in place; and selectively operable latches one at the front of said box and one at the rear of said box for securing said box in position in respect to a support structure and selectively disengageable to open said box forwardly or rearwardly in a compound arcuate and tilting path determined by said pivot arms.

5. In the combination of claim 4 wherein plural of said boxes are supportable beneath plural spaced-apart horizontal covers and between a pair of vertical support elements.

6. In the combination of claim 4 wherein gaskets are engaged between said cover and said upper edges at the front and back of said box whereby a weather-proof upper seal is achieved on closure of said box.

7. In the combination of claim 4 wherein the bottom of said box is corrugated longitudinally and drain vents are included through the bottom of said box.

8. In the combination of claim 4 wherein openings are provided in the ends of said boxes whereby upon displacement of said boxes access is provided to said means for attaching said mounting plate.

* * * * *

UNITED STATES PATENT AND TRADEMARK OFFICE

CERTIFICATE OF CORRECTION

PATENT NO. : 4,372,480

DATED : 1983 February 8

INVENTOR(S) : Terry L. Mitchell, Robert L. Russell

It is certified that error appears in the above-identified patent and that said Letters Patent is hereby corrected as shown below:

Column 1, line 19, change "to" (First occurrence) to read --- do ---

Column 4, line 29, delete "of" after "top"

Column 5, line 48, change "fastener 40" to read --- fastener 49 ---

Column 5, line 57, insert "support" after "upright"

Column 6, line 5, change "26" to read --- 28 ---

Column 6, line 9, change "28" (second occurrence) to read --- 29 ---

Column 6, line 36, insert "of" after "top"

Column 6, line 53, insert "support" after "vertical"

UNITED STATES PATENT AND TRADEMARK OFFICE

CERTIFICATE OF CORRECTION

PATENT NO. : 4,372,480

DATED : 1983 February 8

INVENTOR(S) : Terry L. Mitchell, Robert L. Russell

It is certified that error appears in the above-identified patent and that said Letters Patent is hereby corrected as shown below:

Column 6, line 56, change "as" to read --- is ---

Column 7, line 30, after "box" insert -- moves --.

Signed and Sealed this

*Fifth* Day of *July 1983*

[SEAL]

*Attest:*

GERALD J. MOSSINGHOFF

*Attesting Officer* *Commissioner of Patents and Trademarks*